US005802437A

United States Patent [19]

Wohlfromm et al.

[11] Patent Number: 5,802,437

[45] Date of Patent: Sep. 1, 1998

[54] PRODUCTION OF METALLIC SHAPED BODIES BY INJECTION MOLDING

[75] Inventors: Hans Wohlfromm, Ludwigshafen; Dieter Weinand, Neustadt; Martin Blömacher, Meckenheim; Manfred Schwarz, Ludwigshafen; Eva-Maria Langer, Hemsbach, all of Germany

[73] Assignee: BASF Aktiengesellschaft, Ludwigshafen, Germany

[21] Appl. No.: 535,736

[22] Filed: Sep. 28, 1995

[30] Foreign Application Priority Data

Oct. 7, 1994 [DE] Germany ..... 44 35 904.7

[51] Int. Cl.[6] ..... B22F 3/10

[52] U.S. Cl. ..... 419/37; 419/46; 419/54; 419/58

[58] Field of Search ..... 419/36, 37, 46, 419/54, 58

[56] References Cited

U.S. PATENT DOCUMENTS

| | | | |
|---|---|---|---|
| 5,098,648 | 3/1992 | Kiyota et al. | 419/23 |
| 5,278,251 | 1/1994 | Ohtani et al. | 525/309 |
| 5,280,086 | 1/1994 | Kawamoto et al. | 525/398 |
| 5,292,485 | 3/1994 | Harada et al. | 422/180 |
| 5,328,657 | 7/1994 | Kamel et al. | 419/36 |
| 5,374,391 | 12/1994 | Kuwabara et al. | 419/19 |
| 5,380,179 | 1/1995 | Nishimura et al. | 419/36 |
| 5,380,476 | 1/1995 | Matsushita et al. | 264/63 |
| 5,401,292 | 3/1995 | Japka . | |
| 5,427,601 | 6/1995 | Harada et al. | 75/235 |
| 5,512,080 | 4/1996 | Takahasi et al. | 75/231 |

FOREIGN PATENT DOCUMENTS

| | | |
|---|---|---|
| 356 131 | 2/1990 | European Pat. Off. . |
| 421 811 | 4/1991 | European Pat. Off. . |
| 43 05 201 | 2/1993 | Germany . |
| 1290704 | 11/1989 | Japan . |

OTHER PUBLICATIONS

DATABASE WPI, Section Ch, Week 9002, Derwent Publ., Ltd., Class L03, AN 90-011078, XP 002002654 (English abstract of JP-A 1290704, Nov. 22, 1989).

Chaman LALL, *Metal Powder Ind. Fed.*, 1992, "Soft Magnetism—Fundamentals . . . ", pp. 40–45.

Klar, *Amer. Soc. for Metals*, "Metals Handbook, 9th Edition, vol. 7, Powder Metallurgy", 1982, pp. 495–500.

Zhang et al., *Int. Jrn. of Powder Metallurgy*, vol. 27, No. 3, 1991, pp. 249–254.

*Primary Examiner*—Daniel J. Jenkins

*Attorney, Agent, or Firm*—Keil & Weinkauf

[57] ABSTRACT

Metallic shaped bodies are produced from an injection-molding composition comprising at least one carbonyl metal powder and at least one element powder of metals from the group Cr, Mn, V, Si, Ti or of other metals which are at least as oxidation-sensitive by shaping, removing the binder and sintering. In place of an element powder, it is also possible to use an alloy powder comprising the corresponding metals.

18 Claims, 1 Drawing Sheet

PRODUCTION OF METALLIC SHAPED BODIES BY INJECTION MOLDING

BACKGROUND

The invention relates to a process for producing metallic shaped bodies and to an injection-molding composition which can be used for producing such shaped bodies. In particular, metallic shaped bodies containing oxidation-sensitive metals are to be produced.

Metallic shaped bodies can be produced by shaping a compound, removing the binder and sintering. In powder injection molding, an injection-molding composition is injected into a metal mold and after shaping has the binder removed and is sintered. The injection molding composition has to satisfy certain requirements in terms of morphology and particle size. Particles having spherical geometry show good flow properties and are therefore particularly readily processed in the injection-molding process. Fine powders are sinteractive and lead to a particularly homogeneous alloy having good mechanical properties.

Carbonyl metal powders, ie. powders which are prepared by the carbonyl process by decomposition of the corresponding metal carbonyl, are, owing to their finely divided nature and their spherical particle shape, well suited to producing metallic shaped bodies in an injection-molding process. A disadvantage is that carbonyl powders are obtainable for only a few metals. "Atomized powders", which are prepared by atomization of a metal melt in a jet of gas or water, are also suitable. However, atomization is not possible in the case of high-melting or reactive metals or in the case of alloys which demix on melting. Gas-atomized powders are free flowing since they have a spherical particle structure; but atomized finished-alloy powders are coarse-grained and therefore have little sinteractivity.

Zhang and German (The International Journal of Powder Metallurgy, Vol. 27, No. 3, 1991, pages 249 to 254) describe the use of an injection-molding composition using elemental nickel powder based on a mixture of carbonyl iron and carbonyl nickel powders. U.S. Pat. No. 5,055,128 discloses the use of a cobalt element powder for producing soft magnetic alloys. However, in both cases the powders used are of elements having little oxidation sensitivity.

It is generally considered that homogeneous alloys having high proportions by weight of oxidation-sensitive metals can only be produced using finished-alloy powders. Otherwise, the oxide skins which form would prevent the fine distribution of the metal phase added in elemental form. Impaired properties would result.

It is an object of the present invention to provide a simple process and a simple-to-produce injection-molding composition for producing metallic shaped bodies containing oxidation-sensitive metals. In particular, high-alloy steels containing oxidation-sensitive metals are to be produced.

SUMMARY OF THE INVENTION

We have found that this object is achieved by means of the process described in the claims. Here, an injection-molding composition comprising at least one carbonyl metal powder and at least one element powder of metals from the group Cr, Mn, V, Si, Ti or of other metals which are at least as oxidation-sensitive is shaped, the binder is removed and the body is sintered. The object is also achieved by a process in which an injection-molding composition comprising at least one carbonyl metal powder and at least one alloy powder is shaped, the binder is removed and the body is sintered. The alloy powder comprises at least one metal of the group Cr, Mn, V, Si, Ti or/and at least one other metal which is at least as oxidation-sensitive. The use of the inexpensive carbonyl metal powder here leads to a significant price advantage in the production costs. The process claimed also allows the production of alloys from which finished-alloy powders cannot be produced owing to their high melting point or owing to demixing effects occurring in the melt.

The carbonyl metal powders are preferably present in the injection-molding composition in an amount of at least 30% by weight. Further preference is given to the use of carbonyl metal powders produced from metals of the iron group. Preference is given to using carbonyl iron powder as carbonyl metal powder. The ratio of the mean particle diameter of the carbonyl metal powders to the element and alloy powders is preferably at most 1:2. The alloying metals are preferably present in the metallic shaped body in an amount of at least 5% by weight. Alloying metals are here those metals which have been mixed in by means of element or alloy powders. Preference is given to a sintering process under reduced pressure or in a reducing protective gas atmosphere, in particular in hydrogen, hydrogen/argon or hydrogen/nitrogen, or in an inert protective gas atmosphere, in particular in nitrogen or argon.

The object of the invention is also achieved by means of an injection-molding composition as described in the claims. It comprises at least one carbonyl metal powder and at least one element powder of metals from the group Cr, Mn, V, Si, Ti or of other metals which are at least as oxidation-sensitive. In place of an element powder, the composition can also contain an alloy powder comprising at least one metal of the group Cr, Mn, V, Si, Ti or/and at least one metal which is as oxidation-sensitive.

The injection-molding composition preferably contains a proportion of carbonyl metal powders of at least 30% by weight. The injection-molding composition preferably contains carbonyl metal powders of metals of the iron group, more preferably carbonyl iron powder. The ratio of the mean particle diameter of the carbonyl metal powder to the element and alloy powders is preferably at most 1:2.

Furthermore, there is provided a sintered metallic shaped body which is produced by shaping an injection-molding composition as claimed in any of the claims pertaining to the injection-molding composition, removing the binder and sintering, preferably using a process as claimed in any of the process claims. The proportion of alloying metals is preferably at least 5% by weight.

The shaped bodies produced in this way have lower surface roughness and higher surface gloss, which significantly reduces the expense of further machining.

PREFERRED EMBODIMENTS OF THE INVENTION

EXAMPLE 1

Figure 1:
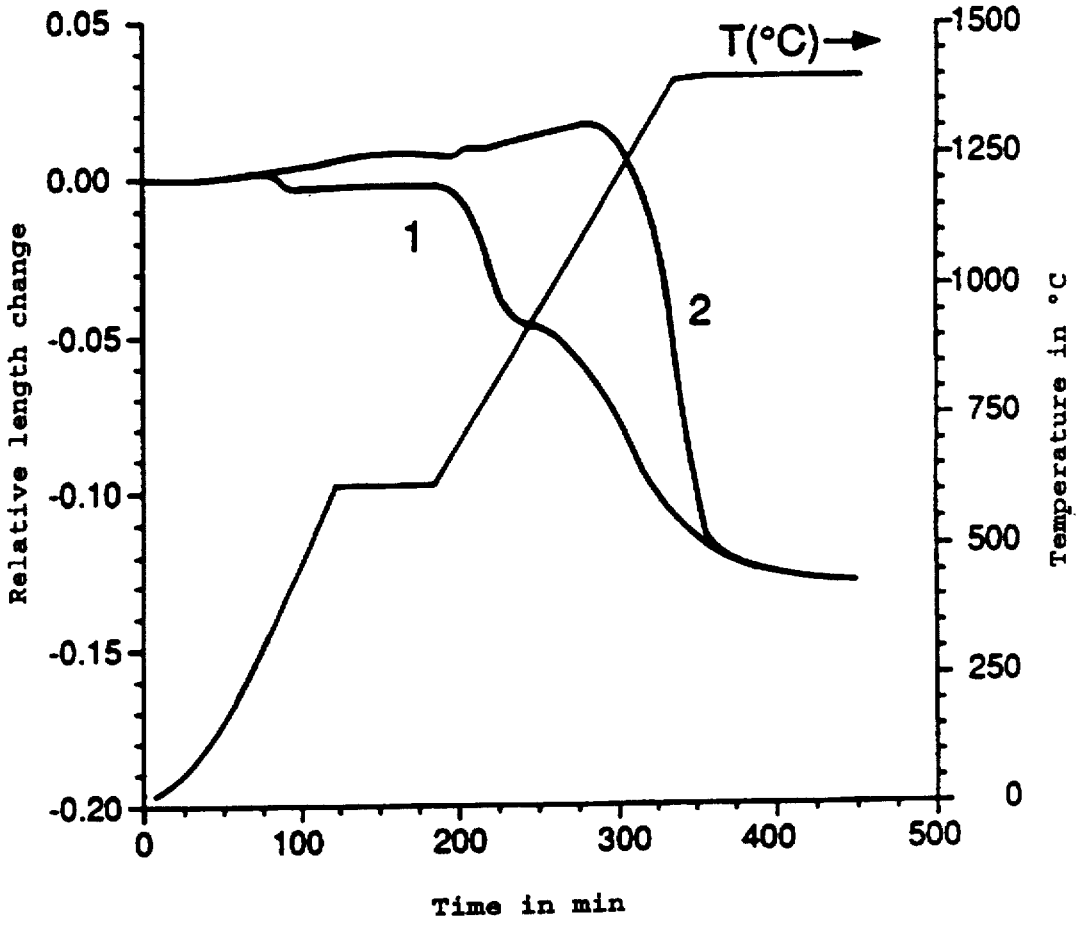
FIG. 1 shows a comparison of the shrinkage behavior of alloys produced by different processes.

To produce shaped bodies of stainless steel of grade AISI 316L, a granulated material was prepared by mixing and compounding a powder mixture with binder materials in a heatable laboratory compounder.

The powder mixture consisted of 6900 g of carbonyl iron powder having a carbon content of 0.7% by weight and a mean particle size of 4 μm and 3100 g of a gas-atomized prealloy of 55% by weight of Cr, 38% by weight of Ni and 7% by weight of Mo, with the mean particle size in the prealloy being below 25 μm. The binder materials used were 952 g of polyoxynethylene and 104 g of polyethylene.

The granulated material obtained was processed in a screw injection-molding machine to give tensile test bars having a length of 85.5 mm and a diameter of 4 mm (in accordance with MPIF Standard 50, 1992).

For comparison, a granulated material was prepared from 8886 g of a finished-alloy powder of the alloy AISI 316L having a mean particle size of <25 μm, 1003 g of polyoxymethylene and 116 g of polyethylene in the manner described and was processed to give injection-molded specimens.

For better comparability, both granulated materials thus contained 62% by volume of metal powder, based on the total granulated composition.

All injection-molded specimens were subjected to catalytic binder removal at 110° C. in a stream of nitrogen of 500 l/h into which 20 ml/h of concentrated $HNO_3$ were metered. The specimens were subsequently sintered in an electrically heated furnace in dry hydrogen having a residual moisture content corresponding to a dew point of −45° C. For this purpose, they were brought to 1360° C. at a heating rate of 5 K/min and held at this temperature for 1 hour.

The density of the sintered specimens, determined by the Archimedes method in water, was in both cases more than 7.7 g/cm$^3$. In both cases, the optical microscopic examination of the polished sections indicated a uniform austenitic microstructure having a low residual porosity in the form of small, closed pores.

Table 1 shows the mechanical properties of the injection-molded parts produced by the different methods, and also their carbon, nitrogen and oxygen contents after sintering.

TABLE 1

Properties of injection-molded, sintered alloys of grade 316L (in accordance with MPFI Standard 50, 1992 and ASTM E8)

| | % C | % N | % O | Yield point $R_{p0.2}$ (MPa) | Tensile strength $R_m$ (MPa) | Elongation at break $A_5$ (%) |
|---|---|---|---|---|---|---|
| of carbonyl iron + CrNiMo prealloy | 0.001 | 0.0007 | 0.007 | 150–180 | 450–500 | 45–57 |
| of finished-alloy 316L powder | 0.05 | 0.0006 | 0.001 | 170–190 | 480–530 | 48–69 |

The comparison shows that injection-molded parts having comparable mechanical properties are obtained by both methods. The carbon, nitrogen and oxygen contents are in both cases below the maximum values required for good corrosion resistance. However, the injection-molded parts produced by the process of the invention have a significantly better surface quality.

FIG. 1 shows a comparison of the shrinkage behavior of the alloys produced by the different processes. For this purpose, the injection-molded green parts were, after binder removal, sintered in a dilatometer.

The relative length change of the cylindrical injection-molded green parts is plotted over the duration of sintering. The associated sintering temperature is given by the temperature curve T(°C.) together with the temperature axis.

Since the granulated materials used in the different processes have the same metal content by volume, the densification of the injection-molded parts can be concluded directly from the length change. It can therefore be seen from FIG. 1 that the injection-molded parts produced by the two different processes achieve about the same final density after sintering. In the case of the specimens produced by the process claimed, shrinkage commences at as low as 600° C. This gives the injection-molded green parts increased strength from this temperature upwards. In contrast, the comparative specimens showed discernable shrinkage only at 1150° C.

Therefore, it is also possible to sinter thin-walled injection-molded parts having complicated shapes without support, without resulting in distortion of the sintered body. The susceptibility of the injection-molded parts to mechanical shocks, as can occur in continuous sintering furnaces, is also reduced.

It was also surprisingly found that the reproduction accuracy of the shaped bodies produced is significantly better than when using atomized powders. This advantage is of particular importance in the case of shapes having long flow paths and thin channels, ie. a high flow path/wall thickness ratio.

EXAMPLE 2

Tensile bars with the binder removed were produced as described in Example 1. In contrast to Example 1, the sintering cycle was interrupted at 600° C. or 1000° C. The flexural strength of the cylindrical specimens thus obtained was determined in a 3-point bend test with a span of 30 mm. The results are shown in Table 2.

TABLE 2

Flexural strength of injection-molded specimens after an interrupted sintering cycle

| Maximum sintering temperature | 600° C. | 1000° C. |
|---|---|---|
| of carbonyl iron + CrNiMo prealloy | 23 ± 1 MPa | 116 ± 26 MPa |
| of finished-alloy 316L powder | <1.5 MPa | 18 ± 3 MPa |

It can be seen that the flexural strength of the alloy produced by the process of the invention from a carbonyl iron powder and a CrNiMo prealloy is significantly higher than for the alloy sintered from a finished-alloy powder in the comparative process. This property is particularly advantageous for industrial manufacture, since the injection-molded parts are less sensitive to mechanical shocks. This also makes the storage of large injection-molded parts of complicated shape simpler.

We claim:

1. A process for producing metallic shaped bodies, wherein an injection-molding composition comprising at least one carbonyl metal powder and at least one alloy powder is shaped, the binder is removed and the body is sintered, where the alloy powder comprises at least one metal of the group Cr, Mn, V, S, Ti and/or at least one other metal which is at least as oxidation-sensitive, wherein the alloy powder is free of iron.

2. A process as claimed in claim 1, wherein the carbonyl metal powders are present in the injection-molding composition in an amount of at least 30% by weight.

3. A process as claimed in claim 1, wherein the carbonyl metal powders used are of metals of the iron group.

4. A process as claimed in claim 1, wherein the carbonyl metal powder used is carbonyl iron powder.

5. A process as claimed in claim 1, wherein the ratio of the mean particle diameter of the carbonyl metal powders to the element and alloy powders is at most 1:2.

6. A process as claimed in claim 1, wherein the alloying metals are present in the metallic shaped body in an amount of at least 5% by weight.

7. A process as claimed in claim 1, wherein the sintering is carried out under reduced pressure or in a reducing protective gas atmosphere or in an inert protective gas atmosphere.

8. The process of claim 7 wherein the reducing protective gas is hydrogen, hydrogen/argon or hydrogen/nitrogen.

9. The process of claim 7 wherein the inert gas is nitrogen or argon.

10. The process of claim 1 wherein the alloy powder is a Cr/Ni/Mo powder.

11. An injection-molding composition for producing metallic shaped bodies, comprising at least one carbonyl metal powder and at least one alloy powder, where the alloy powder comprises at least one metal selected from the group consisting essentially of the group Cr, Mn, V, Si, Ti and/or at least one metal which is at least as oxidation-sensitive, wherein the alloy powder is free of iron.

12. An injection-molding composition as claimed in claim 11, comprising at least one carbonyl metal powder of metals of the iron group.

13. An injection-molding composition as claimed in claim 11, comprising carbonyl iron powder.

14. An injection-molding composition as claimed in claim 11, wherein the ratio of the mean particle diameter of the carbonyl metal powders to the element and alloy powders is at most 1:2.

15. An injection-molding composition as claimed in claim 11, containing at least 30% by weight of carbonyl metal powder.

16. An injection molding composition as claimed in claim 11 wherein the alloy powder does not contain the metal of the carbonyl metal powder.

17. The composition of claim 11 wherein the alloy powder is a Cr/Ni/Mo powder.

18. A sintered metallic shaped body produced by shaping an injection-molding composition as claimed in claim 11, removing the binder and sintering, using a process as claimed in claim 2, wherein the proportion of alloying metals is at least 5% by weight.

* * * * *

UNITED STATES PATENT AND TRADEMARK OFFICE

CERTIFICATE OF CORRECTION

PATENT NO.: 5,802,437

DATED: September 1, 1998

INVENTOR(S): WOHLFROMM et al.

It is certified that error appears in the above-identified patent and that said Letters Patent is hereby corrected as shown below:

Col. 4, claim 1, line 58, "S." should be --Si,--.

Signed and Sealed this

Fifteenth Day of December, 1998

*Attest:*

*Attesting Officer*

BRUCE LEHMAN

*Commissioner of Patents and Trademarks*